United States Patent [19]

Winkler et al.

[11] 4,423,723

[45] Jan. 3, 1984

[54] CLOSED CYCLE RESPIRATOR WITH EMERGENCY OXYGEN SUPPLY

[75] Inventors: Jörg Winkler, Stockelsdorf; Hans Matthiessen, Gross Parin; Ernst Warncke, Lubeck Adalbert Pasternack, Bad Schwartan, all of Fed. Rep. of Germany

[73] Assignee: Dragerwerk Aktiengesellschaft, Fed. Rep. of Germany

[21] Appl. No.: 357,064

[22] Filed: Mar. 11, 1982

[30] Foreign Application Priority Data

Mar. 13, 1981 [DE] Fed. Rep. of Germany ..... 3109658

[51] Int. Cl.[3] ..... A62B 7/04

[52] U.S. Cl. ..... 128/202.22; 128/204.22; 128/205.12; 128/204.26

[58] Field of Search ..... 128/202.22, 202.26, 128/205.12, 204.22, 204.21, 204.26

[56] References Cited

U.S. PATENT DOCUMENTS

| | | | |
|---|---|---|---|
| 2,818,860 | 1/1958 | Hohm et al. | 128/202.22 |
| 3,252,458 | 5/1966 | Krasberg | 128/202.22 |
| 3,556,098 | 1/1971 | Kanwisher et al. | 128/202.22 |
| 3,710,553 | 1/1973 | Parker et al. | 128/204.22 |
| 4,056,098 | 11/1977 | Michel et al. | 128/204.22 |

*Primary Examiner*—Henry J. Recla

*Attorney, Agent, or Firm*—McGlew and Tuttle

[57] ABSTRACT

A closed cycle respirator with emergency oxygen supply is disclosed which comprises a main oxygen flow path from an oxygen bottle into a breathing bag of the closed breathing cycle. A switching valve is provided in the first path and branches off into a second path also for supplying oxygen into the bag. The first oxygen flow path has a solenoid valve therein which is controlled by a first oxygen sensor in the breathing bag. The switching valve is controlled by a second oxygen sensor in the breathing bag for switching oxygen supply over to the second flow path in case the solenoid valve malfunctions or anytime the oxygen in the bag falls below or rises above a set desired limit.

6 Claims, 1 Drawing Figure

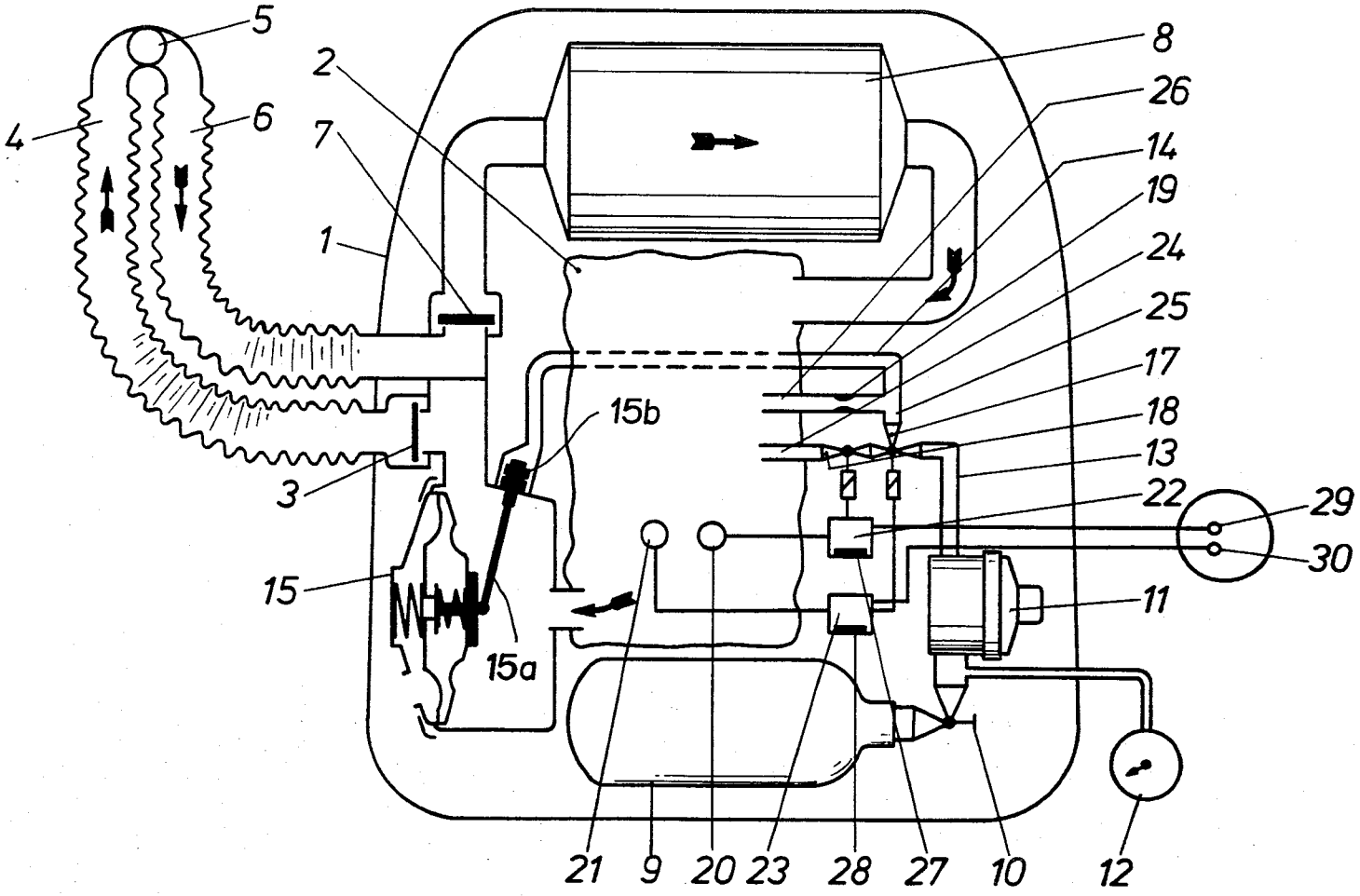
29
30
8
26
14
19
24
25
17
18
13
22
11
12
10
27
28
23
20
9
21
15b
15a
2
7
1
3
15
5
6
4

CLOSED CYCLE RESPIRATOR WITH EMERGENCY OXYGEN SUPPLY

FIELD AND BACKGROUND OF THE INVENTION

The present invention relates in general to closed cycle or rebreather respirators and in particular to a new and useful closed cycle respirator which has an automatically engageable emergency oxygen supply arrangement.

Respirators operating with an electric control on the cycle or rebreather principle make it possible to maintain the oxygen in the cycled breathing air at a desired normal percentage of about 21% independently of the surrounding pressure, e.g. when used as diving equipment. It must, however, be assured that the user of the equipment can safely continue to work also in case the electric breathing gas control should fail or can in any event not regain its starting base.

In a known closed cycle, backpack respirator, the oxygen partial pressure in the cycle is maintained at a desired value by an electronic oxygen regulator.

In a first form of realization the cycle comprises a breathing connection with mouthpiece and one-way valves for the two breathing bags, namely one each on the inhaling and exhaling sides, which are connected together via a $CO_2$ absorption cartridge. Feeding of the required oxygen is effected from a pressure gas bottle through a parallel connection of a throttle adjustable with a handwheel and a solenoid valve, which is closed in the inoperative state, on the entrance side of the absorption cartridge. An electro-chemical oxygen sensor is provided on the exit side of the absorption cartridge and regulates the oxygen partial pressure in the cycle to an adjustable nominal value via an electronic control device and the solenoid valve connected therewith. The measured value of the oxygen partial pressure is visible on an indicator which is worn on a wristband. The adjustable throttle is set so that is assures the minimum oxygen requirement needed for the user's survival. The normal consumption is then replenished via the solenoid valve.

In a second form of this equipment, the replenishment of the consumed oxygen is effected via a series arrangement of a fixed throttle and a solenoid valve which is actuated by the control device and is open in the inoperative state, into the breathing bag located on the inhaling side. In case of breakdown, such as failure of the solenoid valve, an optical and/or acoustic warning signal is given when the signal of the sensor falls below a limit value. Then, through manual actuation of a switching device, the solenoid valve is by-passed and oxygen supplied continuously through the fixed throttle.

A disadvantage is that although an emergency supply is maintained in case of breakdown in the first form of the equipment, it is not sufficient for normal requirements, as may be necessary also for a safe retreat of the user. Therefore, unless the failure is noticed by continuous watching of the indicator, a dangerous oxygen depletion in the cycle may occur just the same. In the second form, manual switching is necessary in case of breakdown. This presupposes that the breakdown is recognized in time by watching the indicator or the alarm and that the user is then still able to act. (See U.S. Pat. No. 3,252,458).

In a known cycle apparatus, in particular for underwater work, the breathing gas, controlled by one-way valves, passes from a mixing chamber via a mouthpiece, which may perhaps be disposed also in a mask, to the user and thence via a breathing bag and a $CO_2$ receiver back into the mixing chamber. A safety valve at the breathing bag relieves any overpressure in the surrounding medium. A gas bottle containing an inert gas-oxygen mixture is connected to the cycle via a pressure regulating valve and a pressure compensating valve as well as a parallel, manually operated pushbutton valve. The cycle can thus be filled automatically or by hand. A second gas bottle containing oxygen is connected with the mixing chamber via a pressure regulating valve and a manually operated pushbutton valve. In parallel with the pushbutton valve, a solenoid disconnect valve and a solenoid valve, which are actuated via an electric circuit, are arranged in series connection. The circuit is connected with two sensors disposed in the mixing chamber, one of which picks up the total pressure and the other the oxygen partial pressure. The circuit arrangement of the circuit indicates the measured values on display devices which are worn on a wristband. The arrangement of the circuit further regulates the oxygen supply by actuation of the solenoid valve in such a way that selectively a constant pressure or a given percentage of oxygen is maintained in the cycle. If the oxygen partial pressure exceeds a limit value harmful to health, the circuit arrangement closes the solenoid disconnect valve until the oxygen value drops again, and it indicates overshooting by the flaring up of an alarm device. In addition, oxygen warning lamps inside the mask indicate whether the oxygen content is in the desired range or above or below it. For increased safety it is proposed to provide a second identical circuit arrangement, in case a fault occurs in the first. As an additional monitoring device the measuring chamber contains a third sensor operating without outside energy which measures the oxygen partial pressure without connection with the circuit and indicates it on an independent gauge. In case of failure, the user can carry out by hand an emergency supply from the gas bottle containing oxygen or containing inert gas-oxygen mixture via the two pushbutton valves. The disadvantage is that despite complicated electronics and instrumentation the user is forced to recognize an occurring breakdown from observation of displays and signals and then to maintain an emergency supply while watching the displays by continued control operations which hinder him in the completion of his task or in his retreat. (See German OS No. 26 08 546).

SUMMARY OF THE INVENTION

An object of the present invention is to provide an electrically controlled respirator which operates on a cycle principle, in which after failure of the control function by a solenoid in the system, switching to an additional breathing air supply occurs automatically.

Another object of the invention is to provide a closed cycle respirator with an oxygen supply in a pressure gas bottle and a carbon dioxide absorption cartridge as well as a breathing air supply control by means of an electric control having a solenoid valve, wherein an oxygen supply from the pressure gas bottle is provided through a pressure reducer and switching valve to a breathing bag. The switching valve is controlled by an oxygen sensor in the bag. The switching valve in a first position supplies oxygen through a first path which is controllable by a solenoid valve. The solenoid valve in turn is controlled by another control device which operates according to the output of another oxygen sensor in the bag. A second flow path is provided from the switching valve through an automatically operable regulator or automatic lung to the breathing cycle. A branch extends from the second path through a proportional flow regulator to the breathing bag for an additional supply of oxygen when the second mentioned oxygen sensor determines too much or too little oxygen in the bag which indicates a failure of the solenoid valve.

A still further object of the invention is to provide the control devices with independent emergency supplies such as batteries.

Another object of the invention is to connect indicators through the control devices for indicating the level of oxygen in the bag.

Another object of the invention is to provide a respirator wherein the oxygen sensors are electrochemical sensors and wherein the control devices are connected to each other with differential elements.

With the failure of control by the solenoid valve, the supply of oxygen into the breathing cycle ceases. By the inventive solution, with automatic switching to another supply path, the equipment user continues to be supplied with breathable gas by the respirator.

The solution consists in providing a switchable valve which is electrically controlled via a second oxygen sensor, which (switching valve), after switching, assures the oxygen supply into the breathing cycle over a new path. In this connection, time-tested means are used, such as a base dosage via a nozzle and an automatic lung or regulator, for compensation of the peak requirement. Here the oxygen requirement is kept as small as possible even after cessation of the normal supply. It thus becomes possible for the equipment user not only to retreat, but moreover to take care of the planned task.

A further object of the invention is to provide a closed cycle respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only drawing is an illustrative diagrammatic view of the closed cycle respirator according to the invention.

DESCRIPTION OF THE PREFERRED EMBODIMENT

Referring to the drawing in particular, the invention embodied therein comprises a closed cycle respirator 1 which includes a closed breathing cycle through a carbon dioxide absorber and breathing bag which is supplied by replenishing oxygen through a first path in normal use and through a second path in emergency use wherein elements in the first path malfunction.

The respirator 1 operates on the cycle principle. The FIGURE shows the setup. The cycle is formed, in the order of flow in the inhalation part of the cycle by a breathing bag 2, an inhalation valve 3, an inhalation hose 4 and a breathing connection 5 to be used by the equipment user. The exhaled air then passes via an exhalation hose 6, an exhalation valve 7 and an absorption cartridge 8 in which the $Co_2$ is removed from the air, and back into the breathing bag 2. The consumed oxygen is replenished from a supply. To this end is an oxygen bottle 9 provided with a shut-off valve 10. Connected to the shut-off valve 10 is a pressure reducer 11, whose reduced or backpressure connection is connected with an electrically controlled switching valve 17 via an oxygen supply line 13. A pressure gauge 12 indicates the oxygen pressure before the pressure reducer 11.

A first flow path leads via a solenoid valve 18 through a line 24 into the breathing bag 2. The solenoid valve 18 is part of a first control device 22 and is controlled by the latter via a first oxygen sensor 20 in the breathing bag 2.

A second flow path out of the switching valve 17 leads through a line 25 for one thing via a branch 26 with proportioning means 19 into the breathing bag 2 and in addition through a switching line 14 to an automatic lung or regulator 15.

The switching valve 17 is controlled by an electric second control device 23 via a second oxygen sensor 21 in the breathing bag 2.

Each of the two control devices 22, 23 has a battery 27, 28 for energy supply. Indicators 29,30 show the readiness to operate or respectively the operation.

During normal operation the respirator 1 and hence the equipment user is supplied with the necessary oxygen over the first flow path. Controlled via the first oxygen sensor 20, the consumed oxygen is replenished into the breathing cycle via the solenoid valve 18. In case of a failure during normal operation and hence of the solenoid valve 18, the oxygen content in the breathing cycle drops. It could happen also that e.g. in case of a maladjustment of the first oxygen sensor 20 or a breakdown of the solenoid valve 18 the oxygen content increases too much. In both cases, after attainment of the fixed concentration limits of oxygen, the switching valve 17 is switched to the second flow path via the second oxygen sensor 21 and the second control device 23. Thus the oxygen then flows in known manner in a base quantity via the proportioning means 19 into the breathing bag 2 and for compensation of a peak requirement controlled by means of the automatic lung 15 through the switching line 14 to the equipment user.

Thus, in normal operation of the respirator sensor 20 senses the amount of oxygen in breathing bag 2 and if there is insufficient oxygen activates control 22 to open solenoid valve 18 and supply oxygen from oxygen bottle 9 through pressure reducer 11 and over the first flow path line 24 to the bag. If the solenoid valve malfunctions and either supplies too little or too much oxygen to breathing bag 2, the second sensor 21 activates the second control unit 23 to switch switching valve 17 over to its position wherein a second path at line 24 is supplied with oxygen from oxygen supply line 13. This path branches into the bag through a proportioning unit or flow reducer 19 and over branch line 26 and, through a switching line 14 to an automatic lung or regulator 15 which operates with a diaphragm in known fashion to move a lever shown at **15*a* which in turn moves a valve member 15*b* off its valve seat and thus opens switching line 14 into the inhalation line 4 through the one way valve 3**.

While a specific embodiment of the invention has been shown and described in detail to illustrate the application of the principles of the invention, it will be understood that the invention may be embodied otherwise without departing from such principles.

What is claimed is:

1. A closed cycle respirator with emergency oxygen supply comprising:

a breathing air circuit;

a breathing bag connected in said circuit;

a carbon dioxide absorber connected in said circuit;

a pressurized oxygen supply container having an outlet;

a pressure reducer connected to said outlet;

an oxygen supply line having one end connected to said pressure reducer;

a switching valve connected to the opposite end of said oxygen supply line and having a first position and a second position;

a first oxygen flow path connected from said switching valve to said bag and communicating with said oxygen supply line when said switching valve is in said first position;

a second oxygen flow path connected from said switching valve to said bag and communicating with said oxygen supply line when said switching valve is in said second position;

a solenoid valve connected in said first flow path;

a first control element connected to said solenoid valve for opening said solenoid valve;

a first oxygen sensor for sensing oxygen in said bag connected to said first control element for activating said first control element to open said solenoid valve when less than a selected amount of oxygen is sensed in said bag;

a second control element connected to said switching valve for switching said switching valve between its first and second position;

a second oxygen sensor in said breathing bag connected to said second control element for switching said switching valve from its first to its second position when a level of oxygen is sensed in said bag to be above a selected upper limit or below a selected lower limit;

proportioning means in said second flow path for regulating a flow of oxygen into said bag from said oxygen supply line with said switching valve in its second position; and a switching line having one end connected to said second flow path and automatically operable regulator means connecting the opposite end of said switching line to said breathing air circuit for supplying oxygen to said breathing air circuit from said oxygen supply line when said switching valve is in its second position and in response to decreased pressure in said breathing air circuit.

2. A closed cycle respirator according to claim 1, wherein each of said first and second control elements are electrically operated and include a battery for powering said first and second control elements.

3. A closed cycle respirator according to claim 1, including an indicator connected to each of said first and second control elements for indicating the operativeness of each of said first and second control elements respectively.

4. A closed cycle respirator according to claim 1, wherein each of said oxygen sensors comprises an electrochemical oxygen sensor.

5. A closed cycle respirator according to claim 1, wherein said breathing air circuit comprises an inhalation line connected to said bag, a junction connected to said inhalation line usable by the user of the respirator for breathing, an exhalation line connected to said junction, said carbon dioxide absorber connected to said exhalation line and between said exhalation line and said bag.

6. A closed cycle respirator according to claim 5, wherein said automatically operable regulator means is connected between said bag and said inhalation line and includes a diaphragm responsive to pressure in said inhalation line, an activating arm movable in response to movement of said diaphragm, a valve member connecting said switching line to said inhalation line and movable to an open position by said arm for connecting said switching line to said inhalation line.

* * * * *